US008052323B2

(12) United States Patent
Takeda

(10) Patent No.: US 8,052,323 B2
(45) Date of Patent: Nov. 8, 2011

(54) WATCH WITH RECESSED ROTATABLE BEZEL AND MANUALLY POSITIONABLE GUARD MEMBER

(75) Inventor: Koremoto Takeda, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 12/658,824

(22) Filed: Feb. 16, 2010

(65) Prior Publication Data

US 2010/0220561 A1 Sep. 2, 2010

(30) Foreign Application Priority Data

Feb. 17, 2009 (JP) ..... 2009-034315

(51) Int. Cl.
*G04B 37/00* (2006.01)

(52) U.S. Cl. ..... 368/286; 368/295

(58) Field of Classification Search ..... 368/276, 368/294–295, 286–290
See application file for complete search history.

(56) References Cited

U.S. PATENT DOCUMENTS 4,158,947 A * 6/1979 Humphrey ..... 368/231
4,975,893 A * 12/1990 Dal Busco ..... 368/294
5,521,889 A * 5/1996 Scarinzi et al. ..... 368/294
5,654,941 A * 8/1997 Joss ..... 368/295
6,599,009 B2 * 7/2003 Terasawa et al. ..... 368/295
7,137,732 B2 * 11/2006 Takeda ..... 368/295
7,614,785 B2 * 11/2009 Hiranuma et al. ..... 368/295
7,648,266 B2 * 1/2010 Saunier ..... 368/286
2003/0099165 A1 * 5/2003 Terasawa ..... 368/294
2008/0285391 A1 * 11/2008 Hiranuma ..... 368/295

OTHER PUBLICATIONS

Patent Abstracts of Japan, publication No. 11-166983, publication date Jun. 22, 1999.

* cited by examiner

*Primary Examiner* — Sean Kayes
(74) *Attorney, Agent, or Firm* — Adams & Wilks

(57) ABSTRACT

A wristwatch is equipped with a case band, a bezel, and a guard. The case band has a circular upwardly directed protrusion to which a transparent dial cover is mounted, a surrounding wall portion forming between itself and the upwardly directed protrusion an arrangement groove extending along this protrusion, and open portions for bezel operation. The bezel having manual holding asperities facing the open portions is rotatably supported in the outer periphery of the upwardly directed protrusion, and arranged in the arrangement groove while forming between itself and the surrounding wall portion a gap extending along the surrounding wall portion. There is arranged in the gap the guard, which is engaged with a detachment preventing portion of the surrounding wall portion and moved in the peripheral direction of the bezel; the guard is movable between a use position where it closes the open portions and obstructs manual holding of the manual holding asperities and a retreated position where it opens the open portions to enable manual holding of the manual holding asperities. The guard is retained at the use position by a positioning means.

20 Claims, 8 Drawing Sheets

WATCH WITH RECESSED ROTATABLE BEZEL AND MANUALLY POSITIONABLE GUARD MEMBER

BACKGROUND OF THE INVENTION

FIELD OF THE INVENTION

The present invention relates to a watch such as a wristwatch or a pocket watch equipped with a rotatable bezel.

A bezel is of a ring-like configuration, and is mounted to the outer periphery of the upper portion of a case band so as to be rotatable in the peripheral direction of the case band. The bezel is rotated by the user, and is arranged at an arbitrary set position. A scale of this bezel is indicated by a long hand of a wristwatch, whereby it is possible to check, for example, the length of time that has elapsed since the rotation of the bezel to the arbitrary position. To secure reliability in this checking, there have been adopted contrivances to retain the bezel so that it may not move from the arbitrary set position, thus preventing an erroneous operation of the bezel.

As such a contrivance, there is known a prior-art technique according to which a bezel cover member is rotatably mounted to a side surface portion of a watch case via a hinge portion; a stepped surface is provided on the inner surface of a frame portion of this bezel cover member, and this stepped surface is engaged with knurls in the form of asperities formed on the outer edge of the bezel, whereby the bezel can be retained at the set position.

In this prior-art technique, the knurls are portions where the fingers of the user are applied when rotating the bezel, and the stepped surface of the bezel cover member is of a configuration in conformity with the knurls. Thus, by opening the bezel cover member, the user can rotate the bezel. After arranging the bezel at the set position, the bezel cover member is closed so as to cover the upper surface of the watch case, whereby it is possible to engage the stepped surface thereof with the knurls to thereby prevent rotation of the bezel (see JP-A-11-166983).

In this prior-art technique, when rotating the bezel, the bezel cover member, which is approximately of the same size as the watch case, is rotated and opened using the hinge portion as a fulcrum so as to open the upper side of the watch case, so that, in this state, the watch presents a figure of a rather large size. Further, if the wristwatch is dropped with the bezel cover member open, it is highly possible that the resultant impact applied to the hinge portion and the bezel cover member in the open state will easily cause them to suffer damage.

As described above, the prior-art technique entails an enlargement in figure/size at the time of operation of the bezel and a low impact resistance at the time of fall due to the contrivance to prevent an erroneous operation of the bezel.

SUMMARY OF THE INVENTION

To solve the above problems, there are provided, according to the present invention, a case band having a circular upwardly directed protrusion to which a transparent dial cover is mounted, a surrounding wall portion forming between itself and the protrusion an arrangement groove, and open portions for bezel operation, with a detachment preventing portion being formed on the surrounding wall portion; a bezel rotatably supported in the outer periphery of the upwardly directed protrusion, arranged in the arrangement groove while forming between itself and the surrounding wall portion a gap extending along the surrounding wall portion, and having manual holding asperities in a peripheral portion; a guard engaged with the detachment preventing portion, arranged in the gap so as to be movable in the peripheral direction of the bezel, and moved between a use position where it closes at least a part of the open portions to hinder manual holding of the manual holding asperities and a retreated position where it opens the open portions to enable manual holding of the manual holding asperities; and a positioning means retaining the guard at the use position, with this retaining being canceled at the time of rotation of the bezel.

In the present invention, it is also possible to provide only one open portion in the case band; however, from the viewpoint of facilitating the rotation of the bezel, it is desirable for such open portions to be provided at two positions corresponding diametrically to each other. In the present invention, it is desirable for the detachment preventing portion of the surrounding wall portion to be formed by a groove open to the inner periphery of the surrounding wall portion and continuous in the peripheral direction from the viewpoint of facilitating the machining thereof; however, in a case in which the guard has an engagement groove as an engagement portion, it is also possible for the detachment preventing portion to be formed by a protrusion engaged therewith. In the present invention, the manual holding asperities may be formed solely in an upper side corner portion of the peripheral portion of the bezel, or the recesses thereof may be formed over the entire vertical range of the peripheral portion of the bezel, with the recesses being open in the upper and lower surfaces of the bezel.

In the present invention, the expression that the guard closes at least a part of the open portions means that the guard is arranged to occupy at least a part of the open portions so as to hinder a finger, etc. of the user from coming into contact with the manual holding asperities of the bezel facing the open portions; in the present invention, when the guard is arranged in this way, the guard is regarded to be arranged at the use position. The size of the guard may be such as closes a part of the open portions at the use position, or such as closes the entire open portions at the use position. In the present invention, the expression that the guard opens the open portions means that when the user tries to rotate the bezel, the guard is arranged off the open portions so as not to hinder the fingers of the user from coming into contact with the manual holding asperities of the bezel facing the open portions; when the guard is arranged in this state, the guard is regarded as arranged at the retreated position.

The guard of the watch of the present invention is moved manually in the peripheral direction of the case band to be selectively arranged at the use position and the retreated position. The guard arranged at the use position is retained by the positioning means in a state in which at least a part of the open portions of the case band is closed, so that an object such as a finger of the user is hindered from inadvertently touching the manual holding asperities of the bezel facing the open portions to impart a rotational force to the bezel, thus preventing an erroneous operation of the bezel. In the case in which the guard is intentionally arranged at the retreated position by the user, the guard does not hinder the user from applying his fingers to the manual holding asperities of the bezel facing the open portions, so that the user can rotate the bezel so as to arrange it at an arbitrary set position.

As described above, the guard, which is a member for preventing erroneous operation of the bezel, is moved in the peripheral direction of the case band along the outer periphery of the bezel and arranged at either the use position or the retreated position, so that even when the guard is moved to the retreated position when rotating the bezel, the figure of the watch can be maintained compact as at the time of normal operation. At the same time, the guard is arranged so as to always extend in the peripheral direction of the circular bezel and, at the retreated position, in particular, it is covered with the surrounding wall portion of the case band. Thus, when, for example, the watch is dropped, the guard is protected by the case band, and the guard does not easily suffer deformation or breakage, thus making it possible to achieve an improvement in terms of impact resistance.

In a preferred mode of the present invention, the guard has finger hooking portions protruding higher than the upper surface of the bezel.

In this preferred mode, when the user moves the guard to the use position or the retreated position, he can do so by hooking his fingers on the finger hooking portions protruding upwardly from the guard without having to perform any operation through an opening, so that it is advantageously possible to attain a satisfactory operability in moving the guard.

In a preferred mode of the present invention, the guard is of a ring-like configuration in plan view, and this guard has an obstruction portion closing at least a part of the open portions, and a bar-like base portion smaller in height than the obstruction portion and extending sidewise from the lower end portion of the obstruction portion in an arcuate fashion.

In this preferred mode, the guard is rotated along the outer periphery of the circular bezel to thereby selectively arrange the obstruction portion thereof at the use position and the retreated position, and when the bar-like base portion is arranged at the open portions, the bar-like base portion does not hinder the operation of hooking a finger on the manual holding asperities, so that it is advantageously possible to facilitate the operation of moving the guard.

In a preferred mode of the present invention, the obstruction portion is formed by an arcuate plate having a length large enough to close the entire open portions.

In this preferred mode, when the obstruction portion of the guard is arranged at the open portions, the entire open portions are closed by the obstruction portion, so that it is advantageously possible to achieve an enhancement in reliability in preventing erroneous operation of the bezel.

In a preferred mode of the present invention, the case band has a pair of bow legs on each of the 12 o'clock side and the 6 o'clock side, and the open portions are respectively provided between the pair of bow legs situated on the 12 o'clock side and between the pair of bow legs on the 6 o'clock side; and the guard is provided with a pair of said obstruction portions and a pair of said bar-like base portions.

In this preferred mode, in the case in which the present invention is carried out in the form of a wristwatch, when moving the guard and when rotating the bezel, with the wristwatch attached to the arm, the hand operating the guard and the bezel does not assume a cramped attitude with respect to thereto, thus making it advantageously possible to operate the guard and the bezel, with the fingers arranged in a natural state with respect to the wristwatch.

In a preferred mode of the present invention, the guard is formed as an integral unit.

In this preferred mode, no increase in the number of components is involved, and the guard has no joints, so that when moving the guard, there is no fear of its being caught by the case band, etc. due to the joints to make the movement of the guard rather non-smooth as in the case in which the guard has joints.

In a preferred mode of the present invention, the guard is composed of a first guard member and a second guard member each semi-circular in plan view and each having the obstruction portion and the bar-like base portion, wherein the first and second guard members are arranged in point symmetry, and the forward end of the bar-like base portion of the second guard member abuts one end of the first guard member in the direction in which an arc of the obstruction portion thereof extends, and the forward end of the bar-like base portion of the first guard member abuts one end of the second guard member in the direction in which an arc of the obstruction thereof extends.

In this preferred mode, the guard is formed by two members of the first and second members arranged in point symmetry, and, through movement of one guard member, the other guard member can be moved by pushing. As a result, as the guard is rotated along the outer periphery of the bezel, the obstruction portions thereof can be selectively arranged at the use position and the retreated position. And, since the guard is formed by two semi-circular members of the same construction, their incorporation into the case band is advantageously easier than in the case in which the guard is formed integrally in a ring-like configuration.

In a preferred mode of the present invention, the positioning means is provided with a lock hole provided in the guard so as to be open in the back surface of the guard held in contact with the bottom of the arrangement groove, and a click stopper provided in the case band and having a click ball detachably engaged with the lock hole and a click spring pressing this ball against the back surface of the guard.

In this preferred mode, the guard can be held in position with at least a part of the open portions of the case band closed, and when the guard retained by the positioning means is moved to open the open portions of the case band, the click ball rotates, so that the guard, the positioning means, and the case band do not impede each other, with the result that the movement of the guard is advantageously smooth.

In the watch of the present invention, despite the contrivance to prevent erroneous operation of the bezel, it is possible to maintain the figure of the watch at the time of bezel operation compact as in the normal state, and it is also possible to achieve an improvement in terms of impact resistance at the time of fall.

DETAILED DESCRIPTION OF THE PREFERRED EMBODIMENTS

Figure 1:
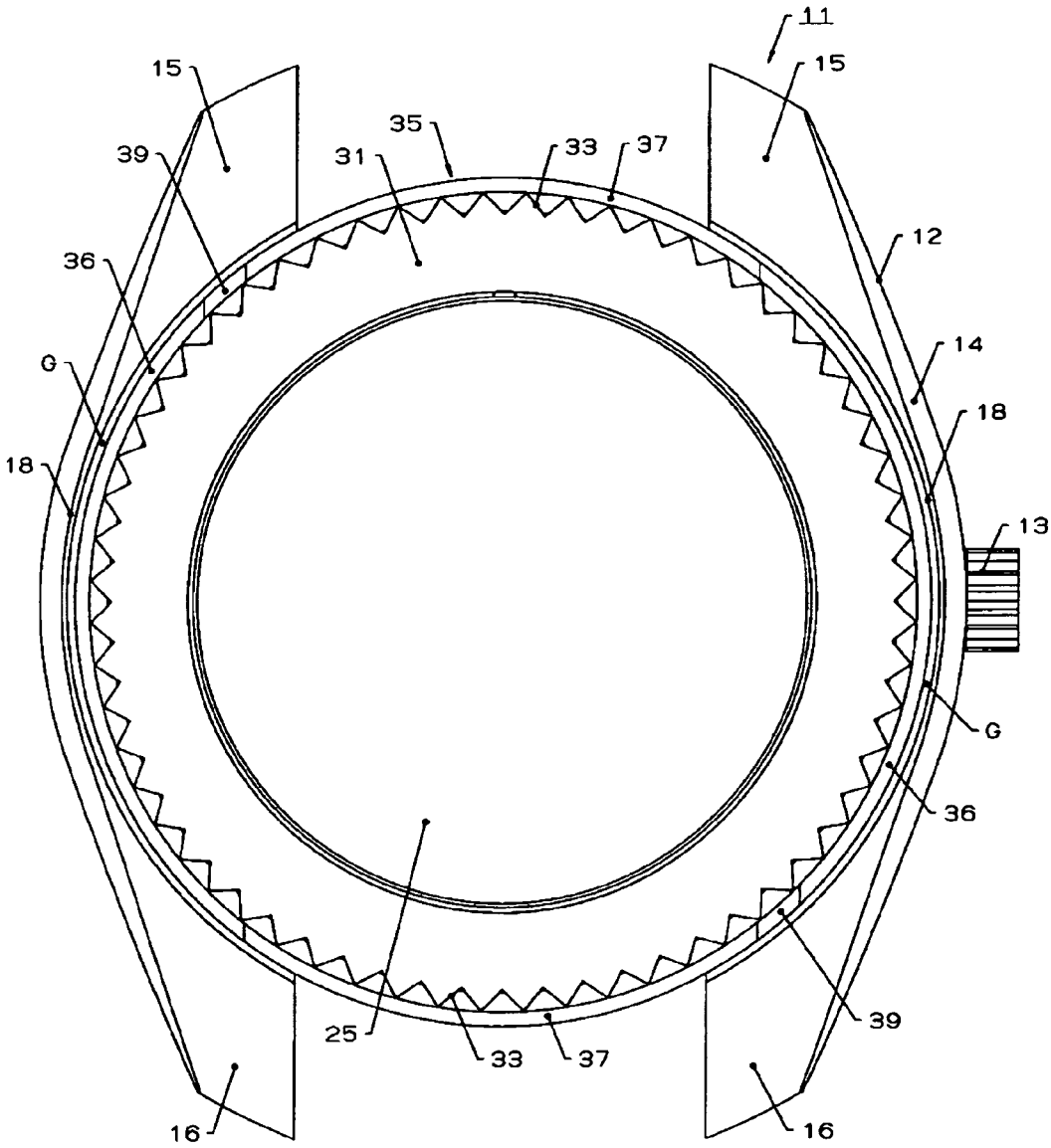
FIG. 1 is a front view of a wristwatch according to a first embodiment of the present invention.

In the following, the first embodiment of the present invention will be described in detail with reference to FIGS. 1 through 7.

In FIGS. 1 through 4, numeral 11 indicates a watch such as a portable watch, more specifically, a wristwatch. Inside a watch exterior member 12, there are provided a watch movement (not shown) and a circular dial. A crown 13 (See FIGS. 1 and 2) is mounted to the watch exterior member 12 in correspondence with the 3 o'clock side of the dial. The crown 13 is operated when adjusting time display hands such as a short hand and a long hand via the watch movement.

Figure 3:
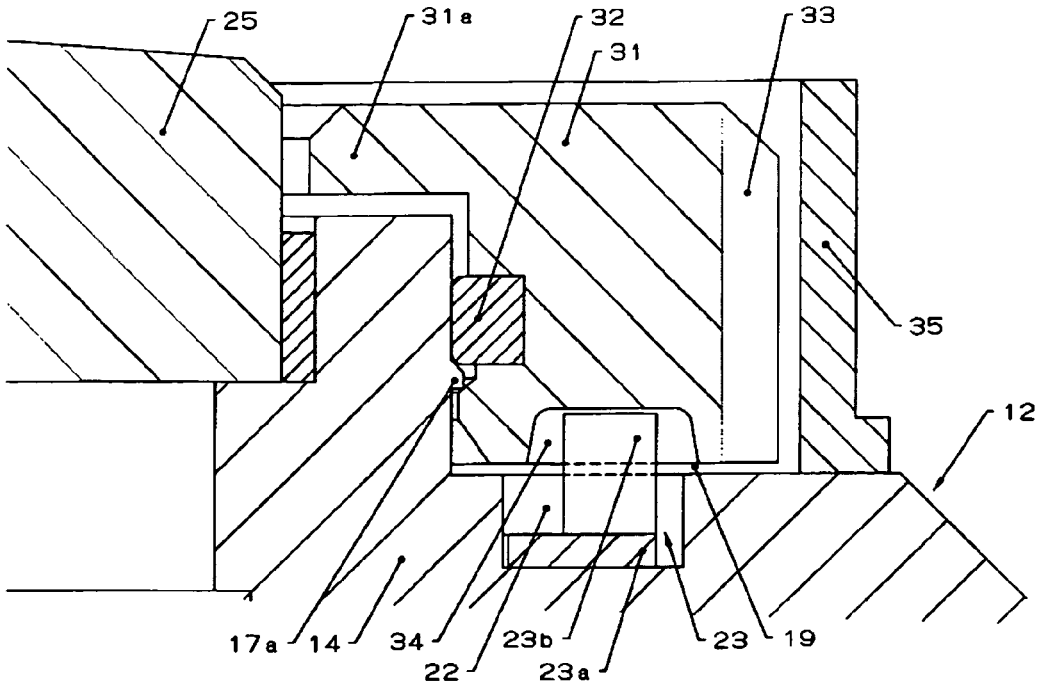
FIG. 3 is a sectional view of the wristwatch taken along the arrow line F3-F3 of FIG. 2A.
Figure 4:
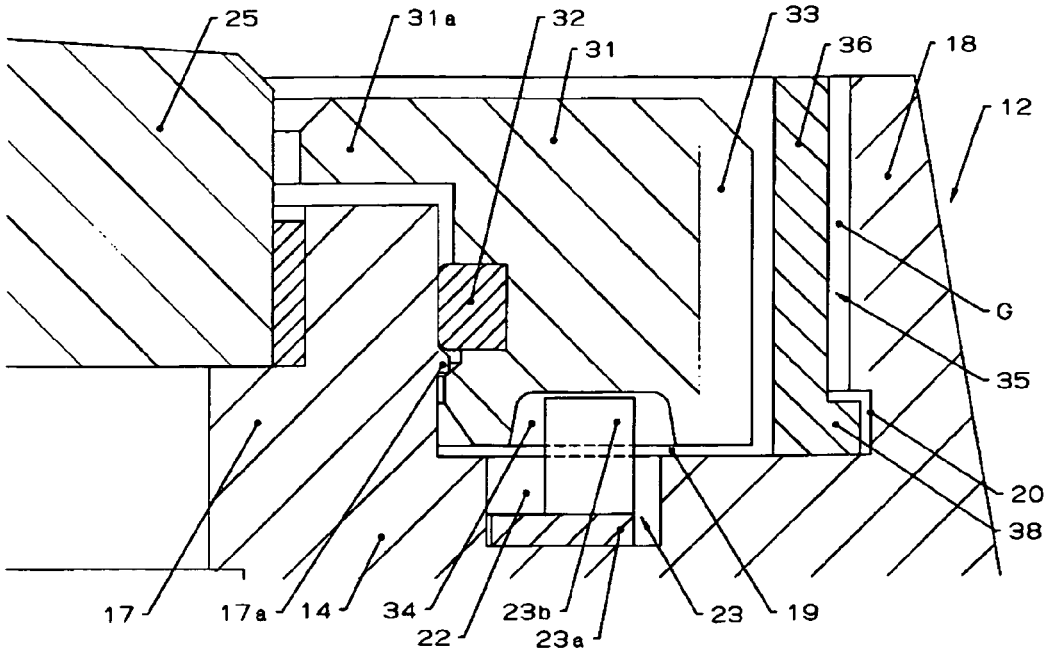
FIG. 4 is a sectional view of the wristwatch taken along the arrow line F4-F4 of FIG. 2B.

As shown in FIGS. 3 and 4, the watch exterior member 12 is equipped with a case band 14, a dial cover 25, and a case back (not shown).

The case band 14 is formed in a substantially annular configuration of a metal such as stainless steel or titanium or synthetic resin. As shown in FIGS. 1 and 2, the case band 14 is integrally provided, on the 12 o'clock side of the dial, with a pair of bow legs 15 spaced apart from each other to the right and left, and, also on the 6 o'clock side of the dial, it is integrally provided with a pair of bow legs 16 spaced apart from each other to the right and left. Attached to these bow-legs 15, 16 is an arm attachment member such as a belt (not shown). The dial cover 25, which allows the dial to be viewed from the outside, is formed, for example, of glass, and is attached liquid-tight to the front portion of the case band 14. The case back (not shown) is formed of metal or synthetic resin; it closes the back side of the case band 14 and is attached liquid-tight to the back side portion of the case band 14.

As shown in FIGS. 3 and 4, the case band 14 is integrally provided, on the front surface portion (upper portion) thereof, with an upwardly directed protrusion (inner wall portion) 17. The upwardly directed protrusion 17 is circular and extends circumferentially around the front side of the case band 14, and the dial cover 25 is attached liquid-tight to the inner periphery thereof. While the upwardly directed protrusion 17 is lower than the upper surface (surface) of the dial cover 25, they may also be substantially of the same height.

As shown in FIGS. 1, 2, and 4, the case band 14 has a surrounding wall portion (outer wall portion) 18 integrally on the front surface portion (upper portion) thereof that extends circumferentially around the front side of the case band 14. The surrounding wall portion 18 is situated on the radially outer side of the case band 14, and forms between itself and the upwardly directed protrusion (outer wall portion) 17 an annular arrangement groove 19. The surrounding wall portion 18 is somewhat lower than, for example, the upper surface of the dial cover 25 but is higher than the upper end of the upwardly directed protrusion 17. A detachment preventing portion 20 (See FIG. 4) consisting of a groove opening to the arrangement groove 19, is formed in the protruding base portion of the surrounding wall portion 18. Both longitudinal ends of the detachment preventing portion 20 are open to open portions 21 described below.

Figure 2A:
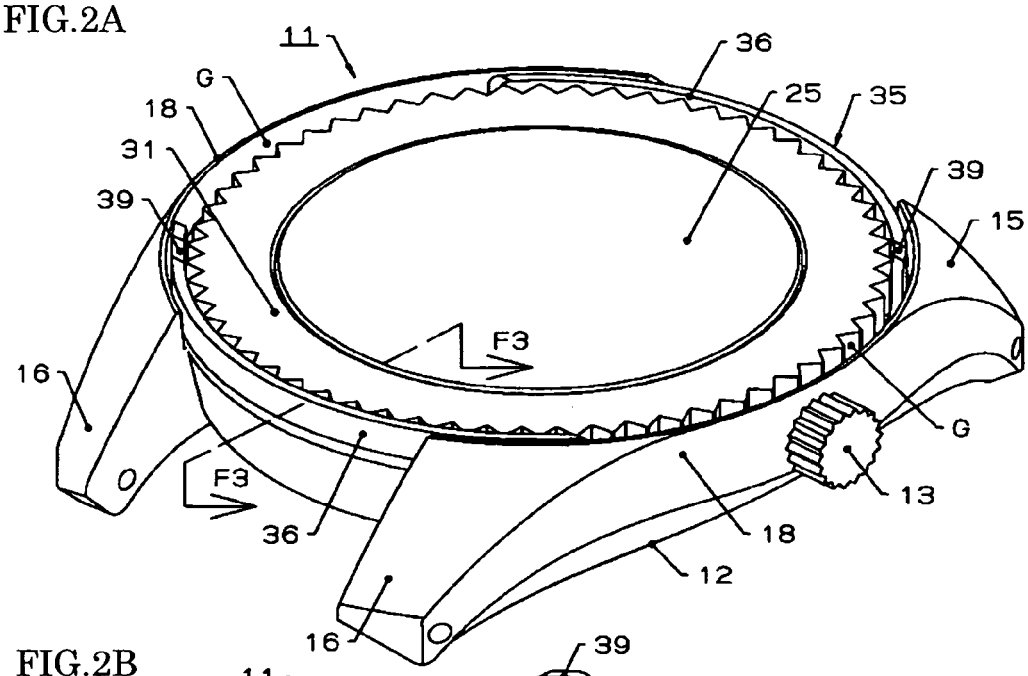
FIG. 2A is a perspective view of the wristwatch of FIG. 1 in a state in which a guard thereof is arranged at a use position where it prevents rotation of a bezel.
Figure 2B:
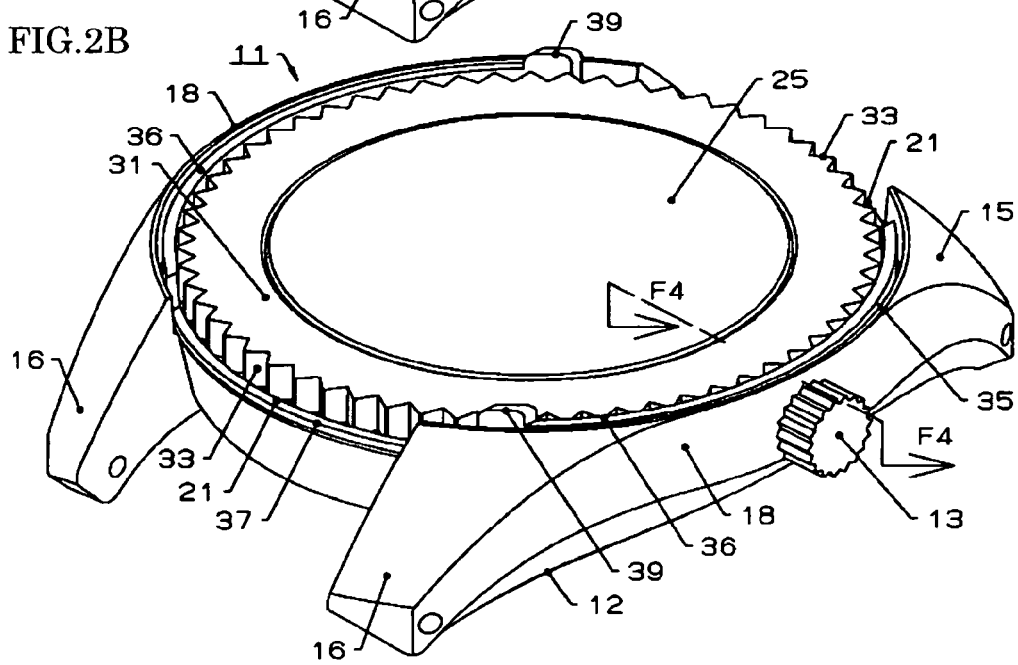
FIG. 2B is a perspective view of the wristwatch of FIG. 1 in a state in which the guard thereof is arranged at a retreated position where it prevents rotation of the bezel.

As shown in FIG. 2B, the case band 14 has two open portions 21. The open portions 21 are provided so as to be circumferentially spaced apart from each other in the circumferential or peripheral direction of the case band 14 by, for example, 180?, with the surrounding wall portion 18 being divided into right-hand and left-hand portions by these two open portions 21. One open portion 21 is provided between the bow legs 15, 15, and the other open portion 21 is provided between the bow legs 16, 16. Stated otherwise, the surrounding wall portion 18 has two open portions 21, one between the bow legs 15, 15 and the other between the bow legs 16, 16. In other words, one open portion 21 is situated on the 12 o'clock side of the dial, and the other open portion 21 is situated on the 6 o'clock side of the dial. The arrangement groove 19 is provided so as to extend along the outer periphery of the upwardly directed protrusion 17, with the upper side thereof being open. The arrangement groove 19 communicates with the two open portions 21.

As shown in FIGS. 3 and 4, in the upper portion of the case band 14, there is formed a recessed groove 22 so as to be situated between the upwardly directed protrusion 17 and the arrangement groove 19. The recessed groove 22 is formed in a ring-like configuration, and is open to the arrangement groove 19. A metal crisp member 23 is mounted to the recessed groove 22. The crisp member 23 is composed of a ring-like base 23*a* and a plurality of crisp pieces 23*b* (only one of which is shown in FIGS. 3 and 4). The base 23*a* is fixed to the bottom surface of the recessed groove 22 by screws. The crisp pieces 23*b* are formed by cutting and raising the base 23*a*, and the forward end portions thereof are bent into a V-shape, etc. The crisp pieces 23*b* allow elastic deformation.

A bezel 31 is rotatably provided in the upper portion of the case band 14. The bezel 31 is formed of metal or synthetic resin in a ring-like configuration. The bezel 31 is arranged in the arrangement groove 19 while forming a gap G between the outer periphery thereof and the surrounding wall portion 18; as shown in FIGS. 3 and 4, it is rotatably supported in the outer periphery of the upwardly directed protrusion 17 while prevented from detachment by being caught from below by an engagement protrusion 17*a* formed to extend in the peripheral direction thereof.

The bezel 31 has in the peripheral side portion thereof manual holding asperities 33. The manual holding asperities 33 are formed by alternately providing over the entire periphery of the bezel 31 protrusions and recesses, for example, of a V-shaped sectional configuration, with the recesses being open in the upper and lower surfaces of the bezel 31. As shown in FIG. 2B, a part of the manual holding asperities 33 faces the open portions 21 of the case band 14, and is exposed to the exterior of the case band 14 and accessible to the user through the open portions 21.

The bezel 31 has in the peripheral portion thereof manual holding asperities 33. The manual holding asperities 33 are formed by alternately providing over the entire periphery of the bezel 31 protrusions and recesses, for example, of a V-shaped sectional configuration, with the recesses being open in the upper and lower surfaces of the bezel 31. As shown in FIG. 2B, a part of the manual holding asperities 33 faces the open portions 21 of the case band 14, and is exposed to the exterior of the case band 14 through the open portions 21.

A large number of crisp grooves 34 (only one of which is shown in FIGS. 3 and 4) are provided in the lower surface of the bezel 31 opposed to the bottom surface of the arrangement groove 19. The crisp grooves 34 divide the lower surface of the bezel 31 into, for example, 60 portions along the peripheral direction of the bezel 31 at a fixed pitch, with the groove sectional configuration taken in a direction orthogonal to the longitudinal direction thereof (the direction connecting the front and back sides of the plane of FIGS. 3 and 4) being V-shaped. Of the crisp grooves 34, the crisp grooves 34 opposed to the crisp pieces 23*b* are detachably engaged with the V-shaped forward end portions of the crisp pieces 23*b*. Thus, when the bezel 31 is rotated, the crisp pieces 23*b* successively enter in and exit out of the crisp grooves 34 while undergoing elastic deformation, with a crisp feel being imparted to the rotation of the bezel 31 each time a crisp groove 34 is engaged.

Figure 5:
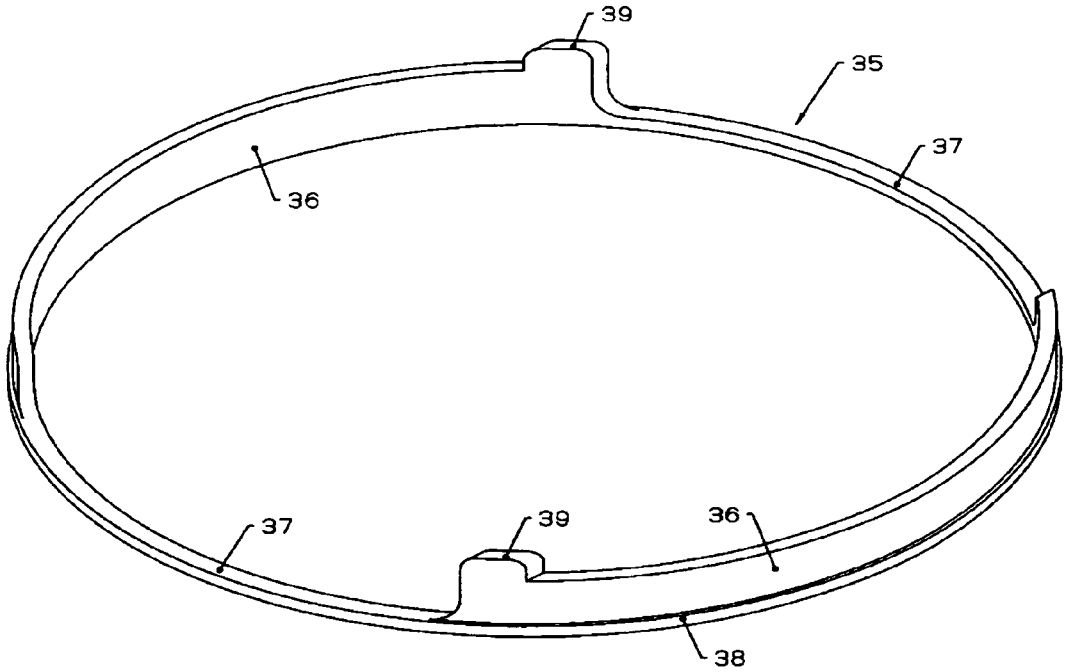
FIG. 5 is a perspective view of the guard with which the wristwatch of FIG. 1 is equipped.

Inside the arrangement groove 19, more accurately, inside the gap G, there is arranged a guard 35 so as to be movable in the peripheral direction of the bezel 31. The guard 35 consists, for example, of an integral metal unit; as shown in FIG. 5, it is formed in a ring-like configuration, and has a pair of obstruction portions 36 and a pair of bar-like base portions 37 arranged alternately with respect thereto. The obstruction portions 36 are formed by arcuate plate portions having a length large enough to close the entire open portions 21 when opposed to the open portions 21. The bar-like base portions 37 are formed as bar-like portions lower than the obstruction portions 36 and extend in an arcuate fashion from the lower end portions of the obstruction portions 36, connecting the obstruction portions 36 integrally with each other.

The guard 35 has an engagement portion 38. The engagement portion 38 is composed of portions outwardly protruding from the lower end portions of the obstruction portions 36 and outer peripheral side portions of the bar-like base portions 37 continuous therewith. The engagement portion 38 is slidably engaged in the detachment preventing portion 20 of the surrounding wall portion 18, whereby the guard 35 is supported so as not to be upwardly detached from the arrangement groove 19.

As shown in FIGS. 2A and 2B, the guard 35 has finger hooking portions (finger engaging portions) 39 protruding higher than the upper surfaces of the bezel 31. The finger hooking portions 39 protrude integrally from the upper surfaces of one end portions in the direction in which the arcs of the pair of obstruction portions 36 extend, and are spaced apart from each other by 180°. The user hooks, for example, his thumb and index finger on the finger hooking portions 39, and in this state, can rotate the guard 35; with this, the obstruction portions 36 can move between the use position and the retreated position.

FIG. 2A shows the obstruction portions 36 as arranged at the use position. In this state, the obstruction portions 36 cover the manual holding asperities 33 of the bezel 31 facing the open portions 21, and the obstruction portions 36 close and obstruct the entire open portions 21 so as to obstruct the rotation of the bezel 31 by the user or the like. FIG. 2B show the obstruction portions 36 as arranged at the retreated position. In this state, the manual holding asperities 33 of the bezel 31 facing the open portions 21 are exposed to the exterior of the case band 14, and the obstruction portions 36 open and do not obstruct the entire open portions 21 and are retracted in the gap G so as to enable rotation of the bezel 31 by the user or the like.

Figure 6:
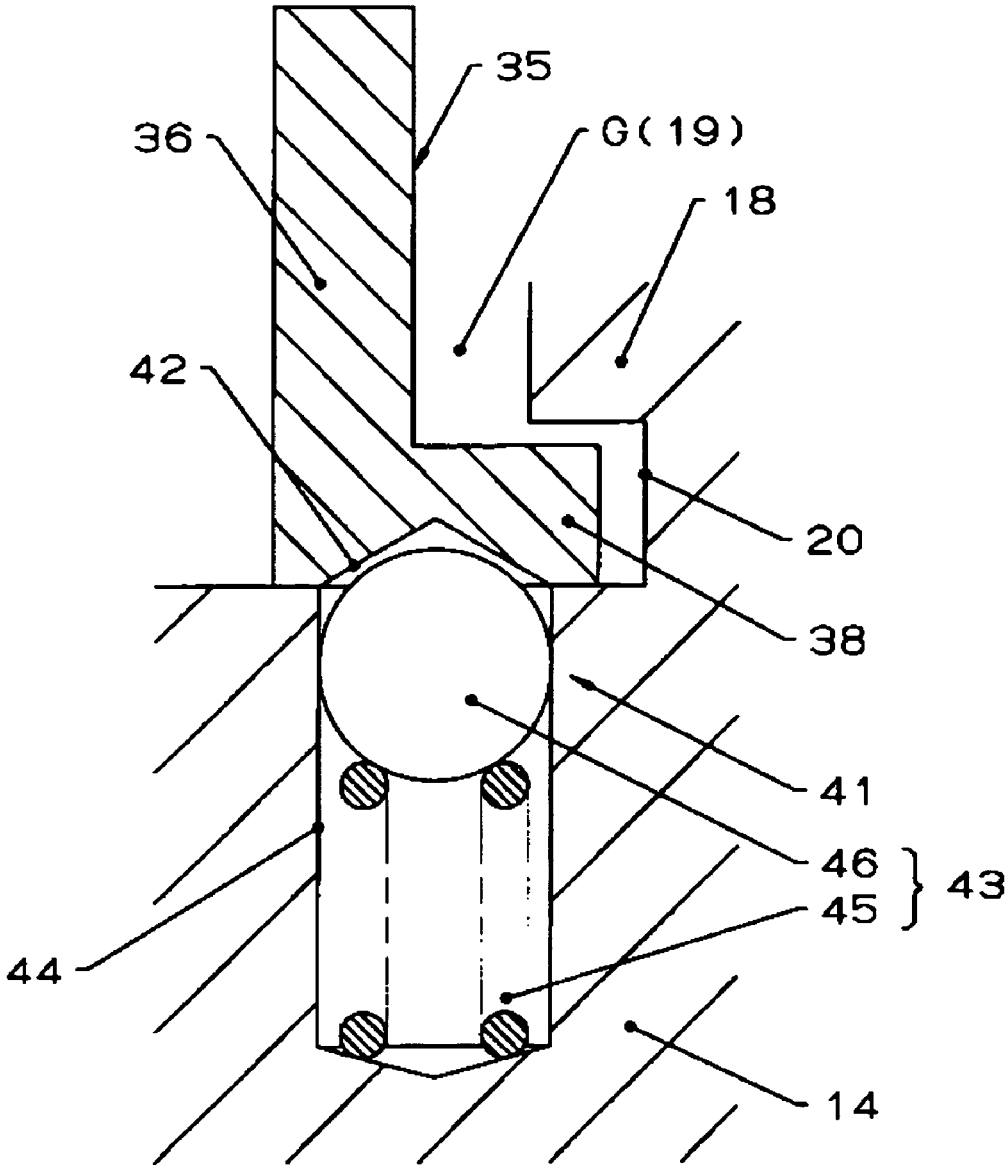
FIG. 6 is a sectional view of a guard positioning means of the wristwatch of FIG. 1.

The wristwatch 11 is provided with a positioning means for retaining the obstruction portions 36 of the guard 35 at the use position. FIG. 6 shows one example of the positioning means, and FIG. 7 shows another example thereof.

A positioning means 41 shown in FIG. 6 is equipped with a lock hole 42 and a click stopper 43. The lock hole 42 is provided so as to be open to the back surface (lower surface) of the guard 35 held in contact with the bottom of the arrangement groove 19. The click stopper 43 has a click spring 45 accommodated in an installation hole 44 formed in the case band 14 so as to be open to the gap G constituting a part of the arrangement groove 19, and a click ball 46 to be engaged/disengaged with/from the lock hole 42. The click spring 45 consists of a coil spring, and a click ball 46 is rotatably mounted to the forward end portion thereof. The click ball 46 consists of a steel ball or the like and is pressed against the back surface of the guard 35 by the spring force of the click spring 45.

In the positioning means 41, the click ball 46 is engaged with the lock hole 42, whereby positioning can be effected on the guard 35 at the use position, and the obstruction portions 36 are maintained in a state in which they close the open portions 21 of the case band 14. When the guard 35 is rotated from the use position and moved to the retreated position, the click ball 46 is detached from the lock hole 42, and is dragged with respect to the back surface of the guard 35 as the guard 35 moves. In this way, when moving the guard 35 to open the open portions 21, the click ball 46 rotates, and the guard 35 does not drag, so that it is possible to smoothly move the guard 35.

Figure 7A:
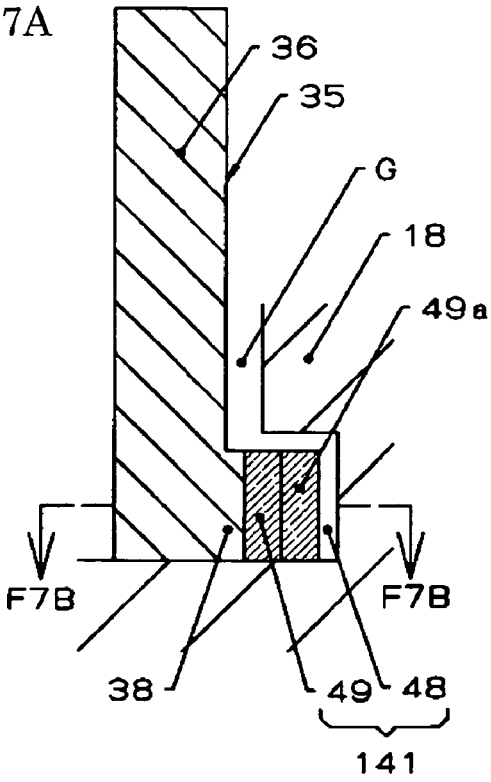
FIG. 7A is a sectional view of another example of the guard positioning means of the wristwatch of FIG. 1.
Figure 7B:
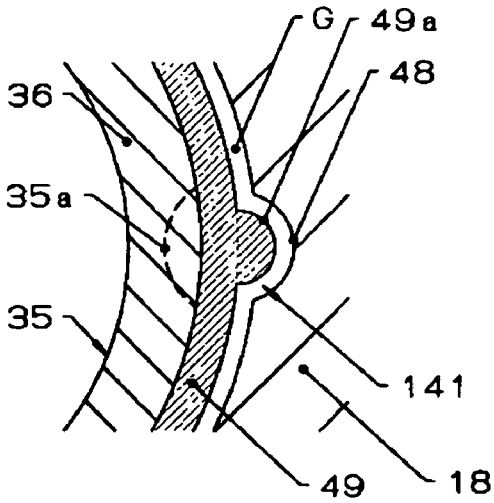
FIG. 7B is a sectional view of a retaining means taken along the arrow line F7B-F7B of FIG. 7A.

A positioning means 141 shown in FIGS. 7(A) and 7(B) is formed not vertically but laterally, and is provided with a lock hole 48 and a click belt 49. The lock hole 48 is open to the gap G constituting a part of the arrangement groove 19, and is formed, for example, at the root portion of the surrounding wall portion 18. The click belt 49 is formed of a rubber-like elastic material, and is fixed to a position of the same height as the lock hole 48, for example, to the engagement portion 38 at the lower end portion of the guard 35 by using an adhesive. A click protrusion 49*a* integral with the click belt 49 protrudes from a part thereof. As the guard is rotated, the click protrusion 49*a* can be engaged/disengaged with/from the lock hole 48 while involving elastic deformation thereof.

As shown in FIG. 7(B), in the positioning means 141, when the click protrusion 49*a* is locked, the guard 35 is set in place at the use position, and the obstruction portions 36 are maintained in the state in which they close the open portions 21 of the case band 14. When the guard 35 is rotated from the use position and moved to the retreated position, the click protrusion 49*a* is detached from the lock hole 48 through elastic deformation of the click protrusion 49*a* and the portion in the vicinity thereof, allowing the guard 35 to move to the retreated position. In the positioning means 141 shown in FIGS. 7A and 7B, to further facilitate the elastic deformation of the click protrusion 49*a*, it is desirable to form an escape groove 35*a* opposed to the back side of this protrusion by scooping out the guard 35. This escape groove is indicated by the dashed line in FIG. 7B.

FIG. 2A shows a normal use state of the wristwatch 11 such as the state in which it is being carried about. In this state, the guard 35 is arranged at the use position. The pair of obstruction portions 36 of the guard 35 arranged at the use position are arranged at the pair of open portions 21 of the case band 14 to close the same, covering the portions of the manual holding asperities 33 of the bezel 31 facing the open portions 21 as shown in FIG. 3. And, the guard 35 at the use position is retained at that position by the positioning means 41 or 141. This retention (positioning) is effected, as shown in FIG. 6, through engagement of the click ball 46 with the lock hole 42 of the guard 35 by the urging force of the click spring 45.

As described above, in the normal use state of the watch, e.g. , when it is being carried about, with the guard 35 being at the use position, the manual holding asperities 33 provided over the entire periphery of the bezel 31 are covered with the surrounding wall portion 18 of the case band 14 and the obstruction portions 36 arranged continuously in the direction in which the arc of this wall portion extends. Thus, the surrounding wall portion 18 and the obstruction portions 36 are arranged in a circular fashion so as to be continuous with each other, so that an object that can impart a rotational force to the bezel 31, such as the finger of the user, is prevented from coming into contact with the manual holding asperities 33.

With this, it is possible to prevent an erroneous operation of inadvertent rotation of the bezel 31 rotated to a desired set position as described below.

Next, the procedures for rotating the bezel 31 to an arbitrary position will be described. First, the guard 35 is moved from the use position to the retreated position shown in FIG. 2B. In this case, while it is possible for the guard 35 to be moved in a rubbing manner in the peripheral direction of the case band 14 at the open portions 21, in this embodiment, the movement of the guard 35 can be effected by utilizing the upwardly directed finger hooking portions 39 formed on the guard 35. That is, the guard 35 can be rotated by hooking the thumb and another finger (e.g., the index finger) onto the pair of finger hooking portions 39 spaced apart from each other by approximately 180° in the peripheral direction and protruding from the front side of the wristwatch 11. As compared with the case in which the guard 35 is moved at the open portions 21, this operation is much easier to perform, and it can be conducted with the wristwatch 11 attached to the arm. Thus, also in the case in which the guard 35 is moved from the retreated position to the use position, the operation can be similarly conducted with ease from the front side of the wristwatch 11.

In this case, first, the inner surface of the lock hole 42 of the guard 35 pushes down the click ball 46 engaged therewith against the force of the click spring 45, and the click ball 46 is detached from the lock hole 42, with the result that the retention of the guard 35 by the positioning means 41 or 141 is canceled; after this, the guard 35 is moved. Due to this behavior, the guard 35 is rotated by approximately 90° to be arranged at the retreated position and, in this state, the obstruction portions 36 of the guard 35 off the open portions 21 are arranged in the gap G between the bezel 31 and the surrounding wall portion 18. In the positioning means 41, when moving the guard 35 to open the open portions 21 of the case band 14, the click ball 46 is dragged by the lower surface of the guard 35, so that the guard 35 does not impede the case band 14, etc., and it can be smoothly moved to the retreated position.

FIGS. 2B and 4 show the guard 35 as arranged at the retreated position. In this state, the open portions 21 of the case band 14 are open and unobstructed. In this state, the bar-like base portions 37 of the guard 35 are arranged at the open portions 21; since the bar-like base portions 37 are much thinner as compared with the height of the open portions 21, they only cover the lower end portions of the manual holding asperities 33; thus, the manual holding asperities 33 of the bezel 31 are sufficiently exposed at and accessible through the open portions 21 to make it possible for the user's fingers to rotate the bezel 31.

Thus, with the wristwatch 11 attached to the arm, the user can grasp the bezel 31 with the thumb and some other finger (e.g., the index finger) arranged at the pair of open portions 21, without being obstructed by the guard 31, and can rotate the bezel 31 by a desired angle. After the bezel 31 has been arranged at the desired set position through this rotation, the guard 35 is rotated again by utilizing the finger hooking portions 39, and the guard 35 is moved from the standby position shown in FIG. 2B to be arranged at the use position shown in FIG. 2A, thereby preventing inadvertent erroneous operation of the bezel 31 arranged at the set position.

The guard 35, which is a member preventing erroneous operation of the bezel 31 as described above, is moved in the peripheral direction of the case band 14 along the outer periphery of the bezel 31 to be arranged at the use position or the retreated position. Thus, as is apparent from comparison of FIGS. 2A and 2B, even in a case in which the bezel 31 is moved to the retreated position when rotating it, it is possible to maintain the figure of the wristwatch 11 compact as in the normal state.

At the same time, the guard 35 is provided so as to always extend along the outer periphery of the circular bezel 31, and, at the retreated position, in particular, it is covered with the surrounding wall portion 18 of the case band 14. Thus, when, for example, the wristwatch 11 is dropped, the guard 35 is protected by the case band 14, so that it does not easily suffer deformation or breakage, thus achieving an improvement in terms of impact resistance.

Further, in the wristwatch 11, which has a pair of bow legs 15, 16 on each of the 12 o'clock side and the 6 o'clock side, the open portions 21 are respectively provided between the pair of bow legs 15, 15 situated on the 12 o'clock side and between the pair of bow legs 16, 16 situated on the 6 o'clock side, with the guard 35 being formed in a ring-like configuration with the pair of obstruction portions 36 and the pair of bar-like base portions 37 being alternately provided. Thus, as described above, when moving the guard 35 and when rotating the bezel 31, with the wristwatch 11 attached to the arm, the hand operating the guard 35 and the bezel 31 does not assume a cramped attitude with respect thereto. Thus, the guard 35 and the bezel 31 can be operated, with the fingers arranged in a natural state with respect to the wristwatch 11.

Further, as described above, the guard 35 having the pair of obstruction portions 36 and the pair of bar-like base portions 37 is formed as an integral unit, so that the number of components of the wristwatch 11 does not increase, nor does the guard 35 have any joint. Thus, there is no fear of the guard 35 being caught by the inner surface of the arrangement groove 19 of the case band 14 during its movement due to the joint to make the movement thereof non-smooth as in the case in which the guard 35 has a joint.

Figure 8:
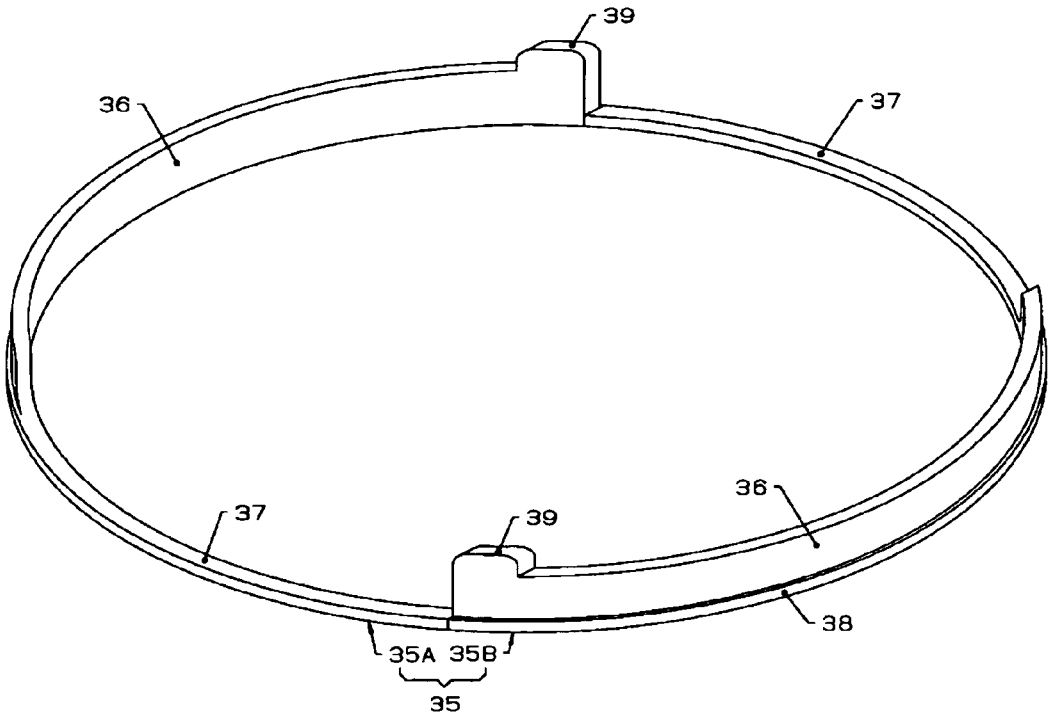
FIG. 8 is a perspective view of a guard with which a wristwatch according to a second embodiment of the present invention is equipped.

FIG. 8 shows a second embodiment of the present invention. The second embodiment is of the same construction as the first embodiment inclusive of the components not shown in FIG. 8 except that the guard 35 is composed of two components. Thus, in the following description, the components that are the same as those of the first embodiment are indicated by the same reference numerals, and a description thereof will be omitted.

As shown in FIG. 8, the guard 35 with which the wristwatch of the second embodiment is equipped is composed of a first guard member 35A and a second guard member 35B each having one obstruction portion 36 and one bar-like base portion 37 and semi-circular in plan view. The first guard member 35A and the second guard member 35B are arranged in point symmetry, and are combined in a ring-like configuration. Thus, the forward end of the bar-like base portion 37 of the second guard member 35B abuts one end of the first guard member 35A in the direction in which the arc of the obstruction portion 36 thereof extends, and the forward end of the bar-like base portion 37 of the first guard member 35A abuts one end of the second guard member 35B in the direction in which the arc of the obstruction portion 36 thereof extends.

When the guard 35, which is formed by the two members of the first guard member 35A and the second guard member 35B, which are arranged in point symmetry as described above, is rotated along the outer periphery of the bezel 31, the movement of one guard member can cause the other guard member to be moved through pushing, whereby the guard 35 is rotated along the outer periphery of the circular bezel, making it possible to selectively arrange the obstruction portions 36 thereof at the use position and the retreated position. Thus, also in the wristwatch of the second embodiment equipped with the guard 35 constructed as described above, it is possible to solve the problem of the present invention for the reason already described with reference to the first embodiment.

Further, as described above, the guard 35 is formed by the two semi-circular members of the same construction, so that the incorporation thereof into the case band 14 is easier as compared with the case in which the guard is formed as an integral ring.

The present invention is also applicable to a portable watch other than a wristwatch such as a pocket watch, and is also applicable to a non-portable watch such as a table clock.

What is claimed is:

1. A watch comprising:

a case band having a circular upwardly directed protrusion to which a transparent dial cover is mounted, a surrounding wall portion forming between the surrounding wall and the protrusion an arrangement groove, and open portions for bezel operation, with a detachment preventing portion being formed on the surrounding wall portion;

a bezel rotatably supported in the outer periphery of the upwardly directed protrusion, arranged in the arrangement groove while forming between bezel and the surrounding wall portion a gap extending along the surrounding wall portion, and having manual holding asperities in a peripheral portion;

a guard engaged with the detachment preventing portion, arranged in the gap so as to be movable in the peripheral direction of the bezel, and movable between a use position where the guard closes at least a part of the open portions to hinder manual holding of the manual holding asperities and a retreated position where the guard opens the open portions to enable manual holding of the manual holding asperities, the guard having finger hooking portions protruding higher than the upper surface of the bezel; and positioning means for retaining the guard at the use position, with the retaining being canceled at the time of rotation of the bezel.

2. A watch according to claim 1; wherein the guard is of a ring-like configuration in plan view, and the guard has an obstruction portion closing at least a part of the open portions, and a bar-like base portion smaller in height than the obstruction portion and extending sidewise from the lower end portion of the obstruction portion in an arcuate fashion.

3. A watch according to claim 2; wherein the obstruction portion is formed by an arcuate plate having a length large enough to close the entire open portions.

4. A watch according to claim 2, wherein the case band has a pair of bow legs on each of the 12 o'clock side and the 6 o'clock side, and the open portions are respectively provided between the pair of bow legs situated on the 12 o'clock side and between the pair of bow legs on the 6 o'clock side; and the guard is provided with a pair of obstruction portions and a pair of bar-like base portions.

5. A watch according to claim 2; wherein the guard is formed as an integral unit.

6. A watch according to claim 2; wherein the guard is composed of a first guard member and a second guard member each semi-circular in plan view and each having the obstruction portion and the bar-like base portion, wherein the first and second guard members are arranged in point symmetry, and the forward end of the bar-like base portion of the second guard member abuts one end of the first guard member in the direction in which an arc of the obstruction portion thereof extends, and the forward end of the bar-like base portion of the first guard member abuts one end of the second guard member in the direction in which an arc of the obstruction thereof extends.

7. A watch according to claim 1; wherein the positioning means is provided with a lock hole provided in the guard so as to be open in the back surface of the guard held in contact with the bottom of the arrangement groove, and a click stopper provided in the case band and having a click ball detachably engaged with the lock hole and a click spring that presses the click ball against the back surface of the guard.

8. A watch comprising: a case band having an annular groove that opens at a front side of the case band and that is defined, in part, by an outer wall portion that extends circumferentially around the case band and that has circumferentially spaced-apart open portions which open into the annular groove; a bezel rotatably mounted in the annular groove and having a peripheral side portion that is accessible through the open portions by the fingers of a user to rotate the bezel;

and a guard movably mounted in the annular groove radially outwardly of the bezel to undergo movement about the bezel between a first position in which the guard obstructs the open portions to hinder user access there through to the peripheral side portion of the bezel and a second position in which the guard does not obstruct the open portions to permit user access there through to the peripheral side portion of the bezel to rotate the bezel.

9. A watch according to claim 8; wherein the outer wall portion has a height in the frontward direction that is equal to or greater than that of the bezel.

10. A watch according to claim 8; wherein the guard has a ring shape having circumferentially spaced-apart obstruction portions that obstruct at least a part of respective ones of the open portions when the guard is in the first position.

11. A watch according to claim 10; wherein the obstruction portions comprise arcuate plates that are large enough to completely obstruct the open portions.

12. A watch according to claim 10; wherein the ring-shaped guard is an integral unit having base portions that interconnect the obstruction portions and that are smaller in height than the obstruction portions so as not to obstruct the open portions when the guard is in the second position.

13. A watch according to claim 10; wherein the ring-shaped guard comprises two arcuate guard segments that abut one another at opposite ends to jointly define a ring shape, each guard segment having a base portion that is connected to one of the obstruction portions and that is smaller in height than the obstruction portion so as not to obstruct the open portion when the guard is in the second position.

14. A watch according to claim 10; wherein the case band has two pairs of legs extending outwardly therefrom on the 12 o'clock side and the 6 o'clock side, and the open portions are respectively provided between the pair of legs situated on the 12 o'clock side and between the pair of legs situated on the 6 o'clock side.

15. A watch according to claim 8; wherein the case band has an inner wall portion that extends circumferentially around the case band and that is spaced from the outer wall portion with the annular groove in between; and further including a transparent dial cover mounted on the inner wall portion.

16. A watch according to claim 15; wherein the height of the inner wall portion in the frontward direction is less than that of the outer wall portion.

17. A watch according to claim 8; further including means for releasably retaining the guard in the first position.

18. A watch according to claim 17; wherein the means for releasably retaining comprises a hole in a back surface of the guard, a hole in the case band at the bottom of the annular groove, and a spring-biased ball disposed in the case band hole and spring biased into releasable engagement with the guard hole.

19. A watch according to claim 17; wherein the means for releasably retaining comprises a hole in an inner surface of the outer wall portion near the bottom of the annular groove, and an elastic protrusion carried by the guard and protruding into the hole to releasably retain the guard in the first position, whereby movement of the guard from the first position elastically deforms the elastic protrusion and releases it from the hole.

20. A watch according to claim 8; wherein the guard has finger engaging portions engageable by the user's fingers for manually moving the guard between the first and second positions.

* * * * *